US006588732B1

(12) United States Patent
Caceres et al.

(10) Patent No.: US 6,588,732 B1
(45) Date of Patent: Jul. 8, 2003

(54) FIBERGLASS FENCING SYSTEM

(76) Inventors: Peter B. Caceres, 715 Katy Rd., Suite 301, Keller, TX (US) 76248; A. Lee Finley, 715 Katy Rd., Suite 301, Keller, TX (US) 76248; John Fakhari, 715 Katy Rd., Suite 301, Keller, TX (US) 76248

( * ) Notice: Subject to any disclaimer, the term of this patent is extended or adjusted under 35 U.S.C. 154(b) by 0 days.

(21) Appl. No.: 09/306,362

(22) Filed: May 6, 1999

Related U.S. Application Data

(60) Provisional application No. 60/091,946, filed on Jul. 7, 1998.

(51) Int. Cl.[7] ..... E04H 17/14

(52) U.S. Cl. ..... 256/19; 256/24; 256/65

(58) Field of Search ..... 256/19, 25, 27, 256/60, 65, 73, 66, 24

(56) References Cited

U.S. PATENT DOCUMENTS

| | | | | | |
|---|---|---|---|---|---|
| 247,537 | A | * | 9/1881 | Connelly | 256/65 X |
| 3,157,255 | A | * | 11/1964 | Sondheim | 256/65 X |
| 3,652,780 | A | * | 3/1972 | Wilson | 174/45 R |
| 3,801,072 | A | * | 4/1974 | Newberry, Jr. | 256/25 X |
| 3,977,653 | A | * | 8/1976 | Fingerson et al. | 256/10 |
| 3,983,956 | A | * | 10/1976 | Manhart | 256/73 X |
| 4,145,032 | A | * | 3/1979 | Robertson | 256/73 |
| 4,188,019 | A | * | 2/1980 | Meredith | 256/65 X |
| 4,306,631 | A | * | 12/1981 | Reusser | 256/73 X |
| 4,357,001 | A | * | 11/1982 | Schmanski et al. | 256/51 |
| 4,815,713 | A | * | 3/1989 | Schmanski | 256/19 |
| 4,836,504 | A | * | 6/1989 | Fingerson et al. | 256/10 |
| 4,889,322 | A | * | 12/1989 | Wagner | 256/36 |
| 4,917,543 | A | * | 4/1990 | Cole et al. | 256/73 X |
| 4,938,445 | A | * | 7/1990 | Medley | 256/65 |
| 5,066,353 | A | * | 11/1991 | Bourdo | 156/300 |
| 5,217,771 | A | * | 6/1993 | Schmanski et al. | 428/36.9 |
| D353,206 | S | * | 12/1994 | Dunbar | 256/19 X |
| 5,639,069 | A | * | 6/1997 | McClure | 256/25 |
| 5,702,090 | A | * | 12/1997 | Edgman | 256/19 |
| 5,967,498 | A | * | 10/1999 | Junell | 256/19 |
| 6,095,503 | A | * | 8/2000 | Burley et al. | 256/25 X |
| 6,179,274 | B1 | * | 1/2001 | Irwin, III | 256/65 |

* cited by examiner

*Primary Examiner*—Eric K. Nicholson
*Assistant Examiner*—David E. Bochna
(74) *Attorney, Agent, or Firm*—Mark Manley

(57) ABSTRACT

A fencing system having rails, slats and posts formed from pultruded fiberglass has several advantageous features. Lightweight fiberglass components are very strong and will not rust like metal fencing and do not require frequent maintenance like wood fencing. Pultruded fiberglass components are easy to manufacture and transport and the finished fence can be assembled using conventional fastners. Fence components are designed to be light weight while having a substantial resistance to bending forces.

4 Claims, 4 Drawing Sheets

FIBERGLASS FENCING SYSTEM

This application claims benefit of provisional application 60,091,946 filed Jul. 7, 1998.

BACKGROUND OF THE INVENTION

The present invention relates to privacy or semi-privacy fencing systems useful for residential and commercial applications.

A variety of privacy and semi-privacy fencing systems have been proposed in the past and several different types are currently on the market. Privacy fencing is typically constructed from panels, boards or slats that provide varying amounts of privacy depending on their spacing.

Many devices and systems have been proposed in the art for meeting the fencing needs of the property owner/manager, such need including but not limited to aesthetic appeal, privacy, and security. One of the most common materials used in the creation of aesthetically attractive residential fencing is wood. While fencing made of newly formed wooden components can be especially attractive, it tends to be expensive to procure, install and maintain, and it tends to degrade over time. Attempts to overcome the problems associated with wood have included making fencing out of metal, such as steel or aluminum, which can be both expensive and heavy when compared to the fence of the present invention. And, like wood, steel needs to be maintained extensively when compared to the instant invention, in order to prevent it from degrading over time. Other attempts to overcome the problems associated with fencing of the prior art have included forming fencing of extruded plastic. Unfortunately, while such attempts may have produced an aesthetically pleasing fence, they have failed to produce a fence having the enduring structural qualities of the instant invention. A primary purpose of the instant invention, therefore, is to provide a fence that has all the advantages of prior art and none of the disadvantages.

The fiber reinforced fence of the present invention is for use in meeting the fencing needs of the property owner/manager, especially for those properties needing an aesthetically pleasing fencing system. As well as being aesthetically pleasing, the present invention provides a fence that is strong and durable relative to both its structural integrity and its surface color. The invention is economically manufactured, transported, installed, and maintained. The present invention is also very efficient with regard to the utilization of existing resources.

BRIEF DESCRIPTION OF A PREFERRED EMBODIMENT OF THE INVENTION

DESCRIPTION OF A PREFERRED EMBODIMENT OF THE INVENTION

Figure 1:
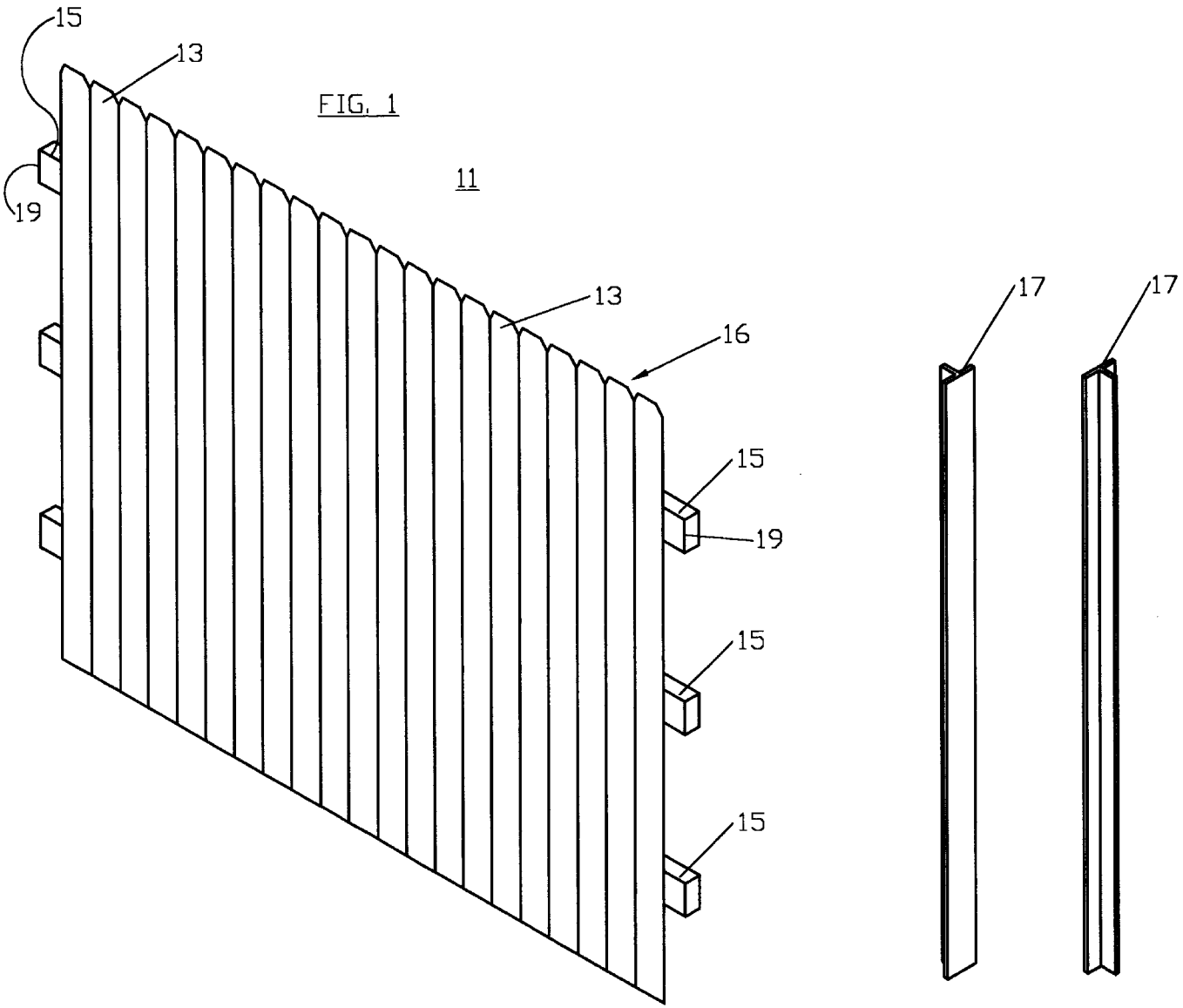
FIG. 1 is a topographic view of a preferred embodiment of a partially assembled fence panel with connecting rails of the present invention.

A preferred embodiment of the fiber-reinforced fence 11 is illustrated in FIGS. 1 through 4. A plurality of elongate fence slats 13 are fixable to a plurality of elongate slat rails 15 for making a fence panel 16. Each of the slat rails 15 is preferably connected at each end 19 to a connecting post 17 planted vertically in the ground (0), such that the rails 15 are parallel and spaced in uniform fashion between the ground and the top of each post 17. The slats 13 are preferably affixed in parallel fashion to one side of the rails 15, such that the slats 13 are parallel to the connecting posts 17. The slats 13 may be spaced such that there is visibility between each slat 13, as in a decorative picket fence, or they may be spaced for providing privacy such that nothing may be seen between each slat, as may be accomplished by placing the slats 13 together in overlapping edge type fashion. The shape of slat 13 not only provides an attractive fence but also provides substantial resistance to bending due to the arc shaped cross section, best seen in FIG. 2. Although thin walled the slat 13 has a substantial bending moment. This strength in bending is important for each of the components that might be subjected to substantial bending forces due to wind or people climbing over the fence. As an alternative, the fence slats 13 might be alternately attached to one side and then the other of the rail 15. Using this method the slats can provide privacy but allow the wind to pass through the fence. Those skilled in the art will recognize various methods for connecting the slats 13, rails 15 and posts 17, including chemical adhesion, bolting, grommeting, nailing, tacking, riveting or the like.

Figure 2:
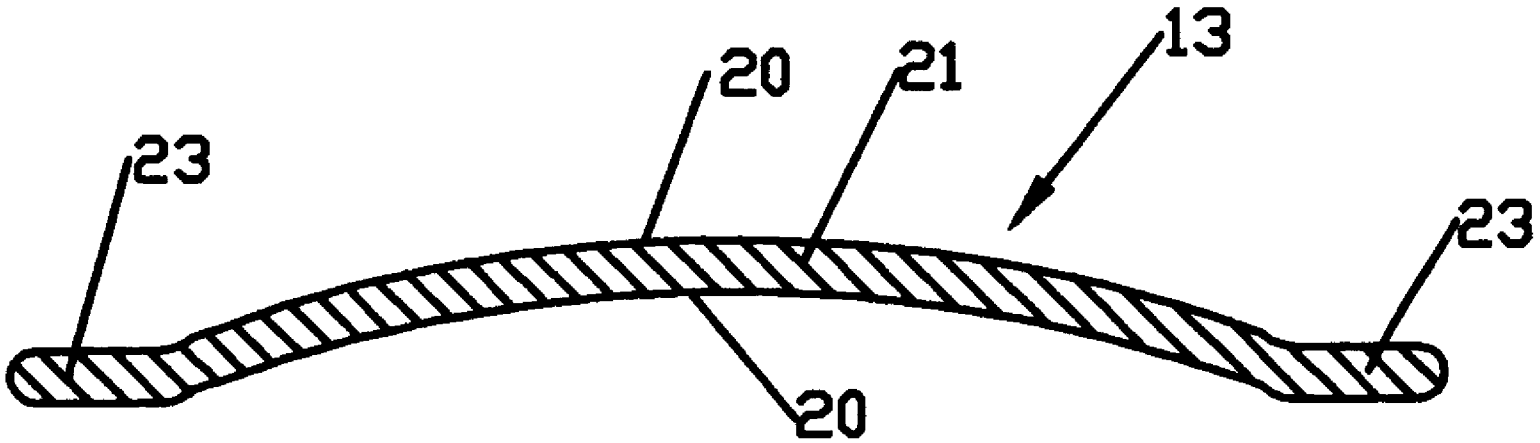
FIG. 2 is a sectional view across the width of a fence slate of the fence panel of FIG. 1.
Figure 3:
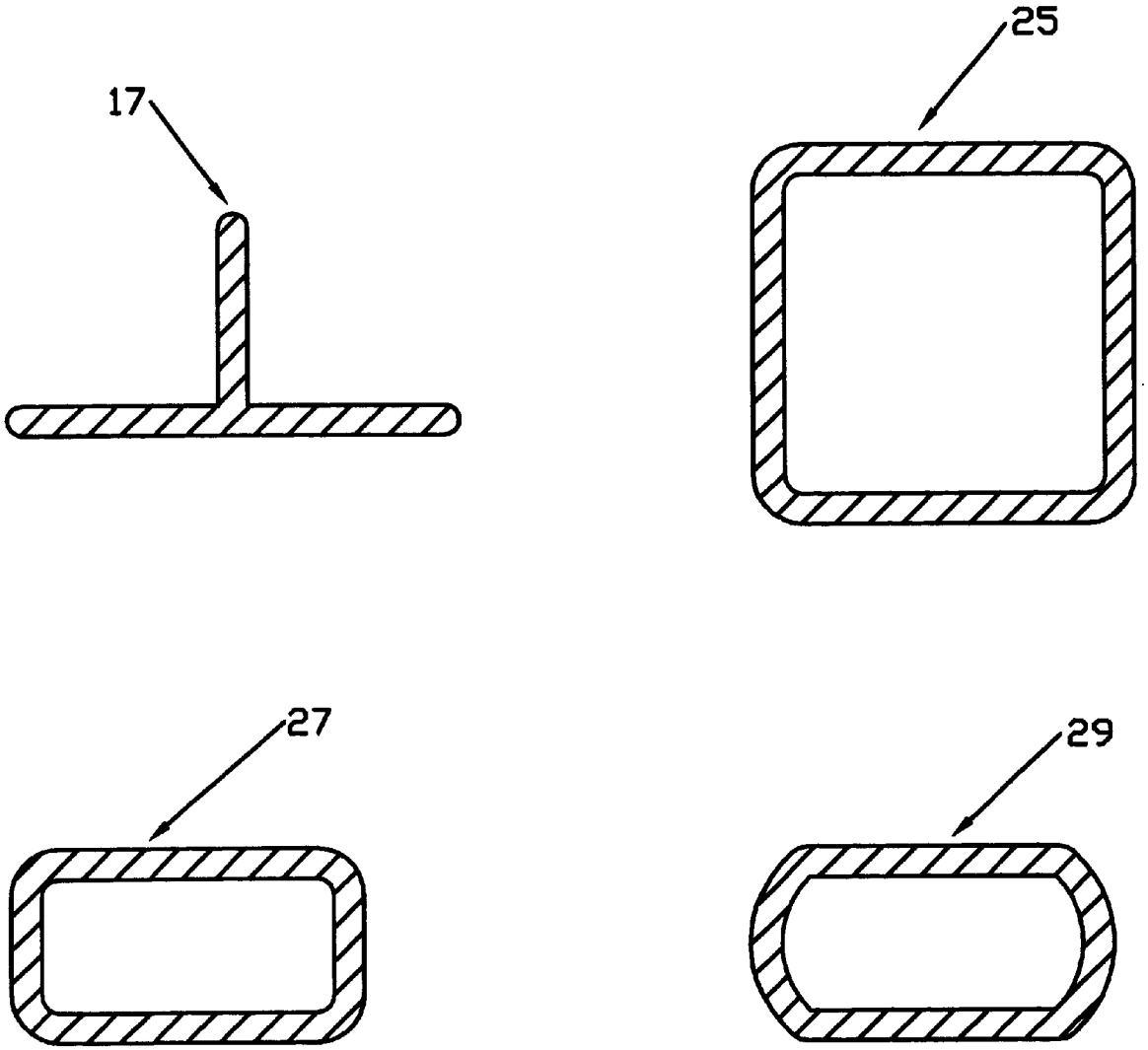
FIG. 3 is a sectional view across the width of various connecting posts of the present invention.
Figure 4:
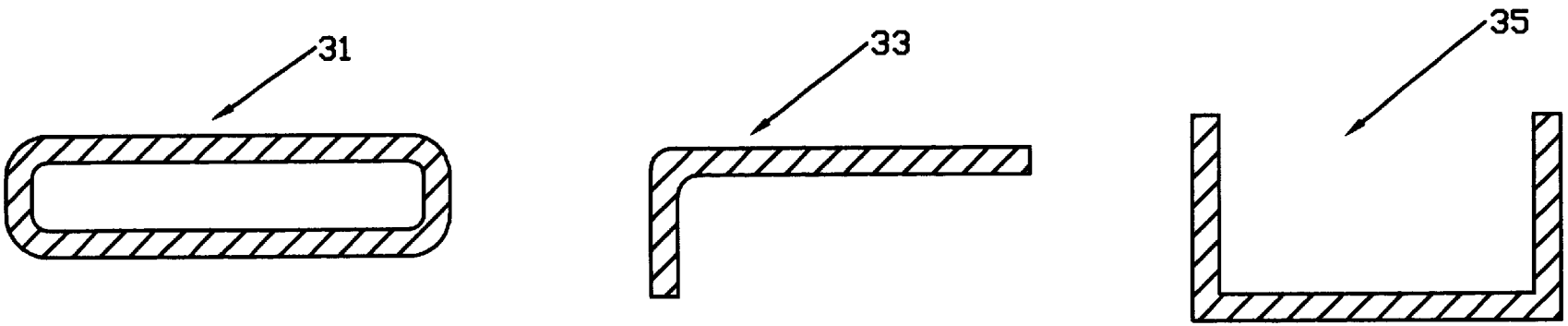
FIG. 4 is a sectional view across the width of various slat rails of the present invention.

FIGS. 2 through 4 illustrate various cross sectional shapes in which the elongate components (i.e., the slats 13, the rails 15, and the connecting posts 17) of the fence 11 may be formed. In FIG. 2 is illustrated a slat 13 having two outwardly opposing faces 20 in the cross-sectional shape of an arc 21 of about 36°, circumscribed between two parallel, co-planar flanges 23 parallel to and extending from either edge of the arc 21. Since the flanges 23 lie in a plane, they allow each slat 13 to be easily affixable to the rails 15 via means such as that which is known. The slats 13 may be affixed to the rails 15 in either singular, slat-by-slat fashion for providing some visibility between each slat, or they may be affixed such that the flanges 23 overlap for providing greater privacy. Flange overlapping would be accomplished by having flanges 23 stacked one on top of the other. This could be accomplished either by having an alternating sequence of slats (one on top, one on bottom, one on top and so on) or by having the left slat always overlap the right slat.

Although the slats are shown in a substantially vertical orientation it would also be possible to mount the slats at an angle to the posts to create a different look. Those skilled in the art will recognize other cross sectional shapes in which slats of the instant invention may be formed to provide good resistance to bending while still being light weight.

In FIG. 3 is illustrated four preferred cross sectional shapes of the posts for use in connecting the fence panels 16 thereto: a short T 17; a hollow, rounded edged square 25; a hollow, rounded edged rectangle 27; and a hollow, elongate oval 29. Each of these shapes is a thin walled design that provides the maximum bending moment for the post while holding the weight and material use to a minimum. For shapes 25, 27 and 29 a cap could be provided to keep the post from filling up with water which could cause freezing problems. Those skilled in the art will recognize other cross sectional shapes in which connecting posts of the instant invention my be formed.

In FIG. 4, is illustrated three preferred cross sectional shapes of slat rails for use in securing the slats 13 thereto and thereby forming the panel 16: a hollow rectangle 31; a rounded corner L 33; and a squared C 35. Again each shape (31,33,35) provides for a light weight design with substantial resistance to bending due to the moment of inertia of the cross section. Those skilled in the art will recognize other cross sectional shapes in which slat rails of the instant invention may be formed.

Each of the above described elongate components of the fence 11 is manufactured via pultrusion: a continuous process technique for producing lengths of fiber-reinforced plastic (FRP) of uniform cross section. Pultrusion is similar to extrusion, but in contrast to the extruding process (in which a resin is forced through a die), the pultrusion process includes combining a resin with reinforcing material, and then pulling the combination through a die. Pultrusion is thought by many to be the most efficient means of producing continuous filament-reinforced plastic composite. The reinforcing fibers are the major determinant of the structural properties of a pultruded product, such as tensile and flexural strength; while the resin is the main determinant of surface properties such as moisture, weather, chemical, and thermal resistance, and electrical properties and burning characteristics.

In each elongate component of the fence 11, it is preferred that the reinforcing fibers include a main fiber core extending parallel to the length of the component, giving said component substantial linear strength. In manufacture, a plurality of fiber strands extend from separate rolls into a die from which the strands extend in parallel. The parallel strands are then run through a vat of resin and drawn through another die, where the plurality of resin-impregnated strands are formed into a unified elongate shape and drawn through an oven in which the resin is hardened. As each elongate component is drawn out of the oven, it is cut via means such as that which is known into desired lengths, and prepared for transporting. The ends of each elongate component may also be cut into a desired shape, or capped for a more aesthetically pleasing or smooth appearance.

For the slats 13, it is preferred that a layer of resin impregnated reinforcing fiber mesh is placed on each outwardly opposing face 20 and drawn through a shaping die prior to insertion of the slat 13 into the oven. The mesh can provide both a desired texture to each face and additional structural support in a direction not parallel to the length of the slat. One desired texture for the slat would be a simulated wood texture. Color may also be molded into the laminate, for a long lasting aesthetically pleasing appearance. Raw materials for common pultrusion manufacturing are readily available and present no procurement problems.

When compared to wooden or extruded plastic fencing of the prior art, the fiber-reinforced fencing of the present invention is high in strength and can be designed to provide a wide range of specific tensile, flexural and impact resistant properties. It can deliver more strength per unit of weight than comparable unreinforced plastic fencing and of most metal fencing. Also, fiber reinforced fencing is extremely lightweight in comparison to steel or aluminum fencing. Since the exterior finish of fiber reinforced fencing of the instant invention is highly impervious to weather and will not rust or corrode, it does not require the periodic painting or shellacking of comparable wooden or steel fencing. There are also many types of resin systems already available for providing an endurable structure in almost any type of chemical environment. In addition, fiber reinforced fencing can be made to resist degradation due to ultraviolet radiation. Pultrusion technology allows for each elongate component of a fiber reinforced fence to be made in various lengths, without costly changes to dies or run set-up time. Tooling represents only a very small part of the product unit costs. Pultruded components hold their forms and shape under severe mechanical and environmental stress. Each elongate component of the five reinforced fence may be formed into almost any shape a designer may desire—simple or complex, large or small.

The inventor has given a non-limiting description of an embodiment of the present invention, to which many changes may be made without deviating from the spirit of the inherent inventive concept. While this invention has been described with reference to such illustrative embodiment, this description is not intended to be construed in a limiting sense. Various modifications and combinations of the illustrated embodiment, as well as other embodiments of the present invention, will be apparent to a person skilled in the art upon reference to this description. It is contemplated, therefore, that such modifications an combination fall within the scope of the present invention.

What is claimed is:

1. A fiberglass fencing system comprising;

a plurality of ground engaging fiberglass posts having a "T" shaped cross section;

a plurality of elongated fiberglass rails connected at each end thereof to one of said posts;

said elongated rails having a hollow rectangular cross section;

a plurality of substantially vertical fiberglass elongated fence slats;

each of said elongated slats having flanges on two sides of the slat for attachment thereof to said rails;

each of said slats having an arc shaped cross section between the flanges;

said rails supporting said slats.

2. The fiberglass fence system of claim 1 including the steps of;

pultruding said slats, posts and rails from resin, cutting said slats, post and rails to preferred lengths as they form, connecting a plurality of said slats in perpendicular relationship to at least two of said rails to form a generally rectangular, preassembled fence section;

shipping a plurality of said preassembled fence panels to a site for installation.

3. A fiberglass fencing system comprising;

a plurality of ground engaging fiberglass posts having a rectangular shaped cross section;

a plurality of elongated fiberglass rails connected at each end thereof to one of said posts;

a plurality of elongated fiberglass slats;

each of said elongated slats having flanges on at least one side of the slat for attachment thereof to said rails;

each of said slats having an arc shaped cross section adjacent to said at least one flange and said rails supporting said slats in a substantially vertical position.

4. A section of fiberglass fence comprising;

A post at each end of the section;

Said post having a generally rectangular cross section;

A plurality of elongated fiberglass rails connected at each end thereof to one of said posts;

each of said rails having a cross sectional area having a bending moment of inertia higher then would a flat cross section;

said rail bending moment of inertia primarily resisting bending of the rail in a direction perpendicular to the fence;

substantially vertical fence slats mounted on said rails; each of said slats having flanges on at least one side of the slat for attachment to said rails.

said vertical fence slats, said rails and said posts are all formed of pultruded fiberglass and wherein the vertical slats include a decorative treatment applied to the surface thereof.

* * * * *